US005090694A

United States Patent [19]

Pauls et al.

[11] Patent Number: 5,090,694

[45] Date of Patent: Feb. 25, 1992

[54] COMBINATION CHAIR AND EXERCISE UNIT

[75] Inventors: Edward A. Pauls, Excelsior; Timothy S. Engel, Bloomington; Michael E. Heutmaker, Long Lake; Robert A. Iverson, Eden Prairie; Jeffrey E. Sandahl, Burnsville, all of Minn.

[73] Assignee: NordicTrack, Inc., Chaska, Minn.

[21] Appl. No.: 500,517

[22] Filed: Mar. 28, 1990

[51] Int. Cl.[5] ..... A63B 21/00

[52] U.S. Cl. ..... 272/134; 272/132

[58] Field of Search ..... 272/72, 73, 93, 117, 272/118, 131, 132, 134, 136, 142, 130; 128/25 R

[56] References Cited

U.S. PATENT DOCUMENTS

| | | | |
|---|---|---|---|
| 3,451,674 | 6/1969 | Lundgren et al. | 272/73 |
| 3,704,886 | 12/1972 | Kay et al. | 272/132 X |
| 3,738,649 | 6/1973 | Miller | 272/134 |
| 3,861,215 | 1/1975 | Bradley | 272/132 |
| 4,235,439 | 11/1980 | De Donno | 272/132 |
| 4,478,411 | 10/1984 | Baldwin | 272/118 |
| 4,500,089 | 2/1985 | Jones | 272/117 |
| 4,521,012 | 6/1985 | Cosby et al. | 272/73 |
| 4,546,971 | 10/1985 | Rassoch | 272/118 |
| 4,603,855 | 8/1986 | Sebelle | 272/118 X |
| 4,625,962 | 12/1986 | Street | 272/132 |
| 4,688,791 | 8/1987 | Long | 272/73 |
| 4,727,860 | 3/1988 | McIntyre | 128/25 |
| 4,728,099 | 3/1988 | Pitre | 272/72 |
| 4,728,102 | 3/1988 | Pauls | 272/132 |
| 4,733,860 | 3/1988 | Steffee | 272/118 X |
| 4,743,011 | 5/1988 | Coffey | 272/72 |
| 4,826,157 | 5/1989 | Fitzpatrick | 272/118 X |
| 4,921,247 | 5/1990 | Sterling | 272/134 X |

*Primary Examiner*—Robert Bahr

*Attorney, Agent, or Firm*—Merchant, Gould, Smith, Edell, Welter & Schmidt

[57] ABSTRACT

A straight back side chair has a seat cushion and a back member, and includes a low resistance loading device that is operated through a system of cords and pulleys from handgrips. The pulleys are supported on arms that are mounted to the back of the chair and which can be selectively positioned for different types of exercise. The arms can be positioned laterally out from the sides of the chair for doing butterfly type exercise; pushed downwardly at an angle for curls; or positioned overhead above the back of the chair for permitting a person seated in the chair to do pull downs. When the chair is not in use as an exerciser, the arms are folded out of the way so it functions as a side chair and does not visually intrude on the usable space in a room or tend to give the room the look of a gymnasium. The force resistance device is very compact so that it takes litter space beneath the seat, permitting a cushioned or padded seat to be used. A panel having a display of counters, force indicators and the like can also be mounted on the chair seat and made to be retractable when not in use.

22 Claims, 11 Drawing Sheets

57
48
56A
112
52
35
35
23
24
46A
53
51
46
25
26
22
12A
45
43
12
30
76
33
33A
38
37
42
39
17
90
35
77

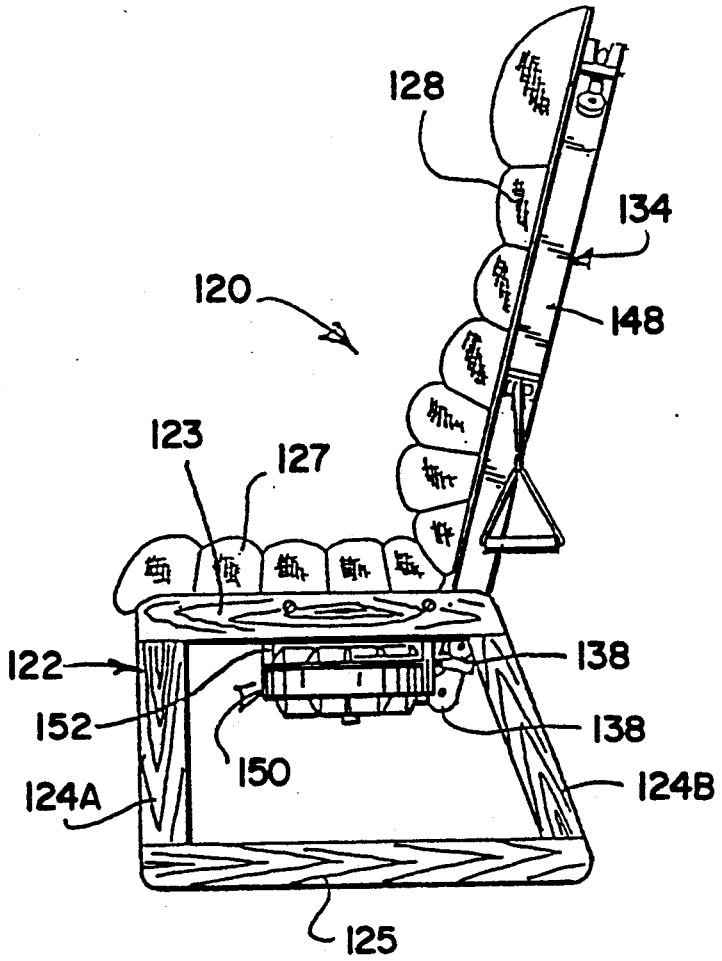
FIG.9
FIG. 13
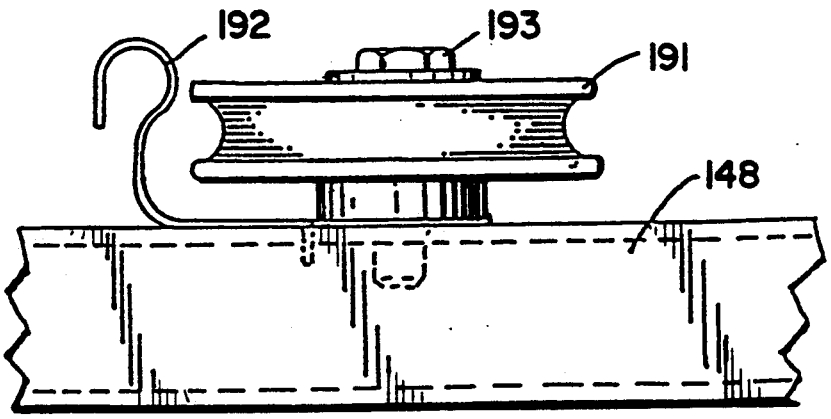

COMBINATION CHAIR AND EXERCISE UNIT

BACKGROUND OF THE INVENTION

The present invention relates to a combination chair and upper body training exercise device which has exercise apparatus that may be folded and stored so that the unit converts to the appearance of a side chair rather than an exerciser. The chair is provided with a padded cushion and back and can be upholstered in suitable fabric for matching a desired decor.

While the prior art shows various types of exercising devices, including weight machines that use benches, cables and pulleys and loading devices, none comprise a device which is a conventional straight back chair in appearance that can be easily converted to provide exercise facilities for exercising the upper body.

Upper body exercising units, such as rowing machines and simulated swimming motion machines, are widely used. Storage is a problem, particularly in smaller homes. A typical rowing machine is shown in U.S. Pat. No. 4,743,011, which uses a flywheel as a resistance or loading member and has arms or oars that drive sprockets by the rotating motion of the oars, and are connected to the flywheel to provided a constant resistance force.

A variable resistance exercising device is shown in U.S. Pat. No. 4,521,012, which uses a crank type, hand-operated upper body exercise drive.

U.S. Pat. No. 4,728,099 shows a chair unit that provides for various exercise activities, and includes a variable resistance force generating device. It employs a flywheel driven by centrifugal clutches.

U.S. Pat. No. 4,546,971 shows an exercising device in which a person exercising is seated, and the number of stacked weights are provided for loading.

U.S. Pat. No. 4,500,098 describes a machine that has a saddle type seat with a number of levers and actuators positioned around the seat for exercising.

A leg exerciser is shown in U.S. Pat. No. 4,478,411 which includes a bench and seat on which the person doing the exercises is positioned. The amount of force being exerted can be changed as desired.

Additional patents which illustrate various loading devices include U.S. Pat. No. 4,728,102 which shows an arm exerciser that has an adjustable friction resistance device. A swimming motion exerciser that provides for total body exercise is shown in U.S. Pat. No. 4,688,791. A knee exerciser that is operated by a seated person is shown in U.S. Pat. No. 4,727,860.

However, none of these patents illustrate a device which is a typical side chair, which can easily be converted into an exercise unit by unfolding arms which support cords or lines that can be pulled by a person seated in the chair. The loads are variable, as a function of the speed of movement of the hand grips and lines.

A wide variety of weight lifting machines are on the market, which use benches for seating and various cable arrangements for lifting weights. These generally have large frames and are not convertible to a side chair.

Various types of pull exercises, and pivoting arm exercises have been advanced. For example, MGI Strength Fitness, Inc. makes and sells an isokinetic exerciser called the MINI-GYM, which has pull ropes that load in proportion to the amount of force being applied. Such devices can be either wall or floor mounted, or mounted on fixed frames for providing the resistance force for exercise. These devices are gymnasium type devices, and have the appearance of conventional exercisers. Flexible lines or ropes are used in various frame assemblies for these isokinetic exercisers.

SUMMARY OF THE INVENTION

The present invention relates to an exerciser comprising a side chair with a force resistance loading system positioned under the seat of the chair, and which has an upright back supporting adjustable folding arms. A system of flexible lines or cords and pulleys are provided between the loading device and hand grips on the outer ends of the lines, so that the hand grips can be grasped by a user seated in the chair and various exercises performed.

When the unit is not in use as an exerciser, it functions as a household side chair. The chair, as shown, has an upholstered seat and upholstered back, and only takes up the space of a chair. It can be used as a chair without giving the room the look of a gymnasium. The arms used during exercising fold completely out of the way, and the finished appearance permits the unit to become a multipurpose piece of furniture which serves as an exerciser.

The exercise force generating unit is positioned below the chair seat, and is of a small enough size so that it does not protrude excessively into view. It is an isokinetic exercise unit in that the resistance force increases to match the applied force or speed, so no adjustments are required as strength of the person exercising increases or when different people use the exerciser. The chair provides a safe form of exercise since there are no weights that will fall or cause a strain on muscles, and the resistance force will stop as soon as the applied force is removed from the handgrips.

As muscles are fatigued during the exercise, the exercise regime can continue at a slower pace and the loads will automatically be reduced.

The arms that are pivotally mounted onto the back of the chair and which carry the lines or cords leading to the resistance force generating device can be adjusted to several different positions without any substantial effort, so a changeover for different types of exercisers can be easily done. The arms then fold out of the way when the exercise is over.

The combination chair and exerciser provides the ability to do pullovers, pull downs, chest crosses, butterflies (with the arms either up or down), chest presses and biceps curls. Thus, the exerciser permits a wide range of exercises for complete conditioning.

BRIEF DESCRIPTION OF THE DRAWINGS

FIG. 9 is side elevational view of a preferred embodiment of the invention showing a modified frame construction of the present invention;

FIG. 13 is a fragmentary sectional view showing a modified pulley retainer user with the form of the invention shown in FIG. 10.

DESCRIPTION OF THE PREFERRED EMBODIMENTS

Figure 3:
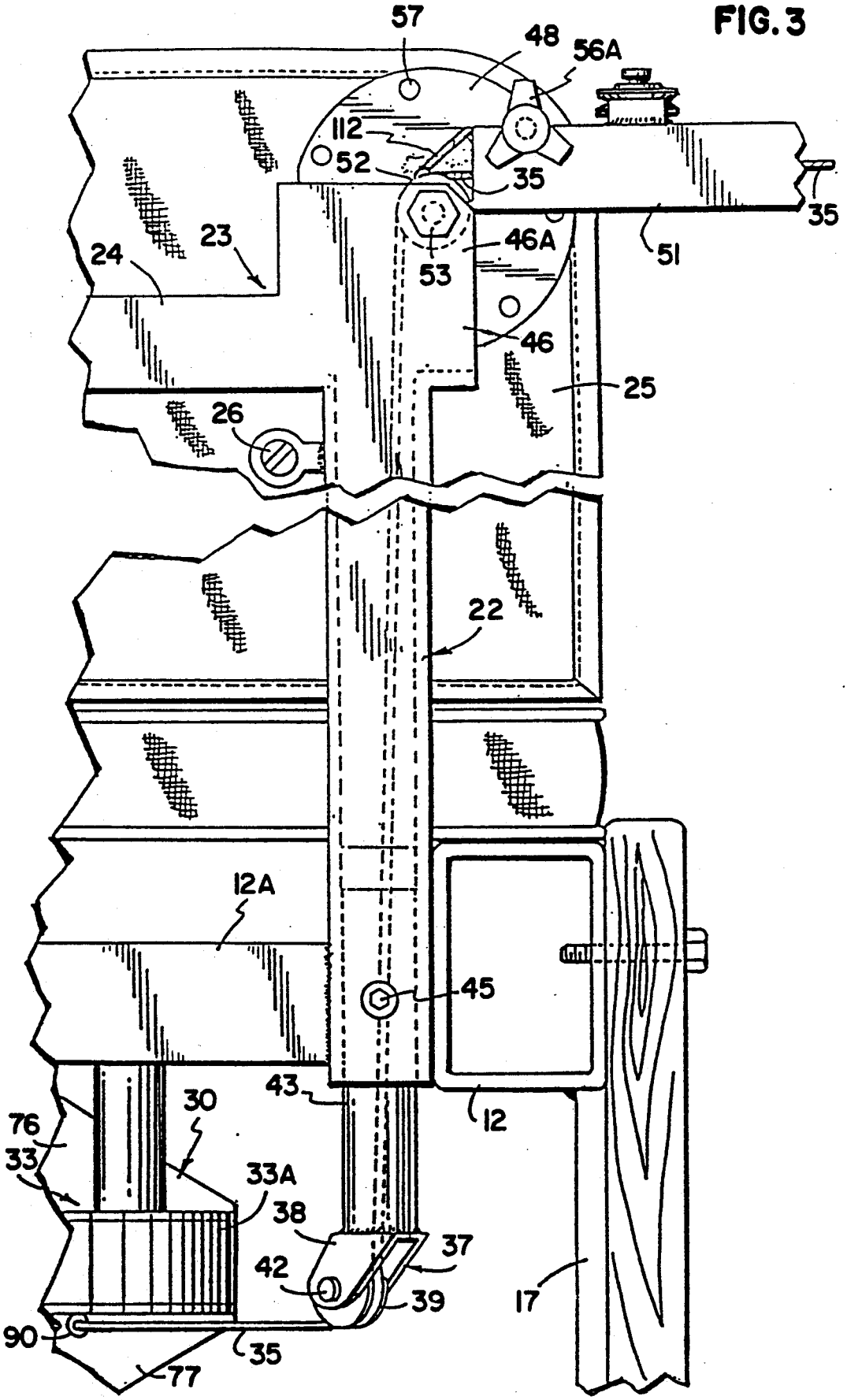
FIG. 3 is a fragmentary rear view of the chair of FIG. 2 showing an exercise support arm in a generally horizontal position and located in place.

A combination exerciser and chair indicated generally at 10 is shown with the exercise supports or components in a retracted or folded position, whereby the chair 10 appears as an attractive piece of household furniture. The chair includes a frame 11 that comprises tubular steel fore and aft extending side members, one of which is shown at FIG. 3 at 12, and cross members 12A at the front and rear. The frame members are sturdy tubular steel members, which provide strength with small size and low weight. The frame is covered with suitable exterior finish frame members or moldings comprising wooden cross members 13 and wooden fore and aft extending members 14.

Legs 15 are provided for supporting the frame, and these legs, as shown in FIG. 3 also have suitable tubular steel structural members 17 with decorative finish wood molding on the exterior.

A seat cushion 20 is supported between the side members 14 and is supported on the side frame members 12. The seat cushion 20 is positioned so that it is secure and stably supported. The seat cushion 20 has an upholstered upper cushion for comfort and is also made sturdily, to support the weight of a person doing exercise with the convertible chair assembly 10.

The frame 11 includes tubular steel upright side frame members 22 that are fixed to the side frame members 12 to form a back frame 23 that& has transversely extending cross members 24. The upright frame members 22 are positioned on each side of the chair back, as shown in FIG. 3. The members 22 form main upright supports for a back cushion 25 that is suitably fastened with fasteners 26 to the back frame 2. The back frame 23 is very rigidly connected to the cross members 12A and the fore and aft extending side frame members 12 to form an integral, very rigid support frame for the exercise apparatus.

The exercise apparatus which forms part of the combination exerciser and chair I0 comprises a loading or force generating assembly, which will generate isokinetic resistive forces for loading muscles that are being used to move (extend) pull cords through hand grips. The exercise apparatus is made so that the direction of force to be applied by the person seated and performing the exercise can be changed to exercise different muscles and to provide force directions that are selected for an overall upper body exercise program. A feature of this combination furniture chair and exercise device is that the exercise apparatus can be folded to a position or stored so that the chair will serve as a piece of furniture and will not give a gymnasium look to the room. In order to serve as a functioning exerciser, the loading force providing device has to be capable of providing resistive forces that are adequate for a wide range of loads, to in turn accommodate a number of different levels of exercise, and also permit the user to vary the forces across a range of exercises from a warm-up period to a full load period.

Figure 1:
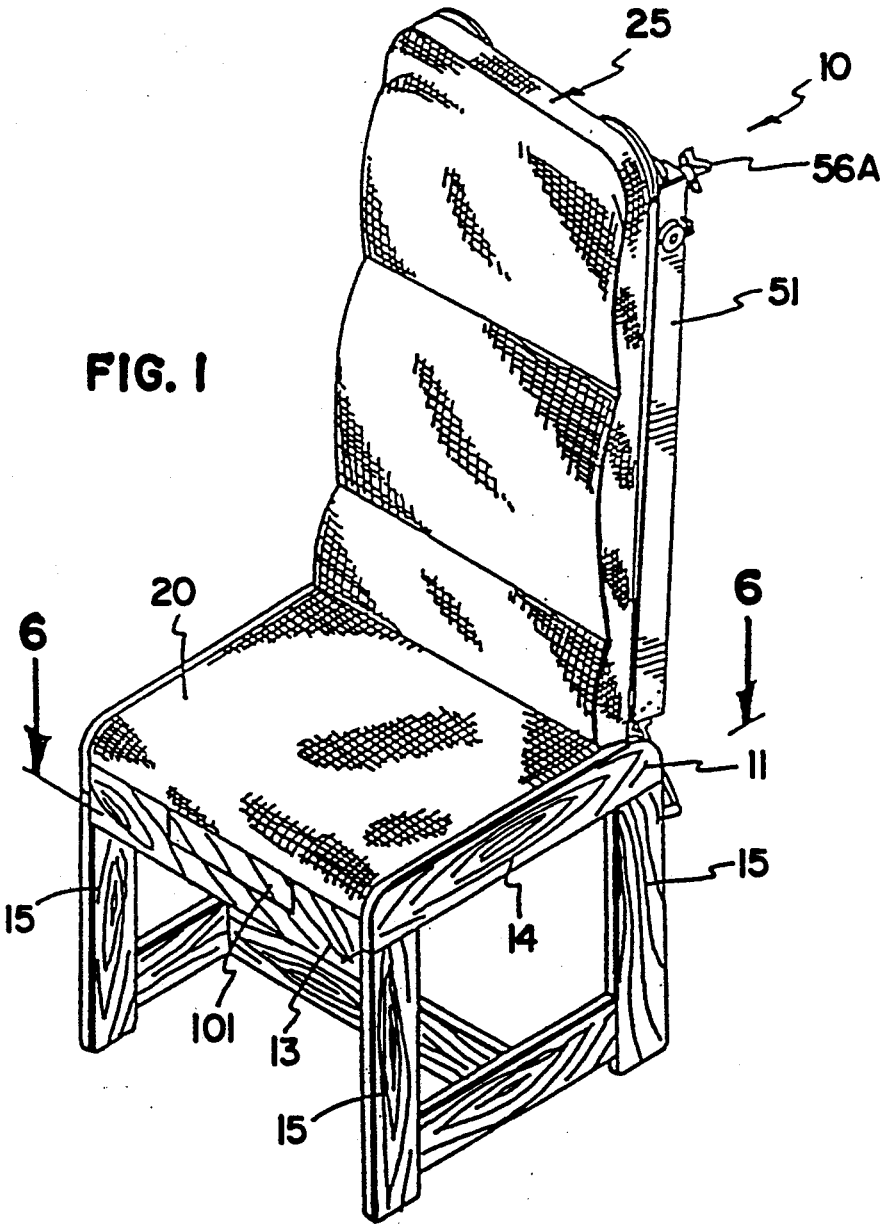
FIG. 1 is a perspective view of a combination chair and exercise device made according to the present invention.

FIG. 1 shows the exercise apparatus retracted, and it can be seen that the chair shape is not visually disrupted, because all of the parts used for conversion to an exerciser are stored and retracted to be within the lateral width of the chair and within the perimeter of the height of the chair. Thus, the chair has supports for pulleys and loading lines or cords that can be moved to desired positions for exercise and then retracted within the height and width periphery of the chair, and not protrude excessively in fore and aft directions of the chair. The back of the chair is normally against or near a wall and helps shield the exercise unit components. However, if the exercise unit components extend rearwardly a substantial distance, it would be objectionable, so that with the present device a very compact rearward extension is provided, and all the rest of the components needed for exercise are within the height and width periphery of a normal side chair.

The loads provided are designed for muscle toning and strengthening exercises, and the exerciser is made operable easily and quickly to encourage exercise at moments when one might otherwise be engaging in activities such as watching television.

Figure 6:
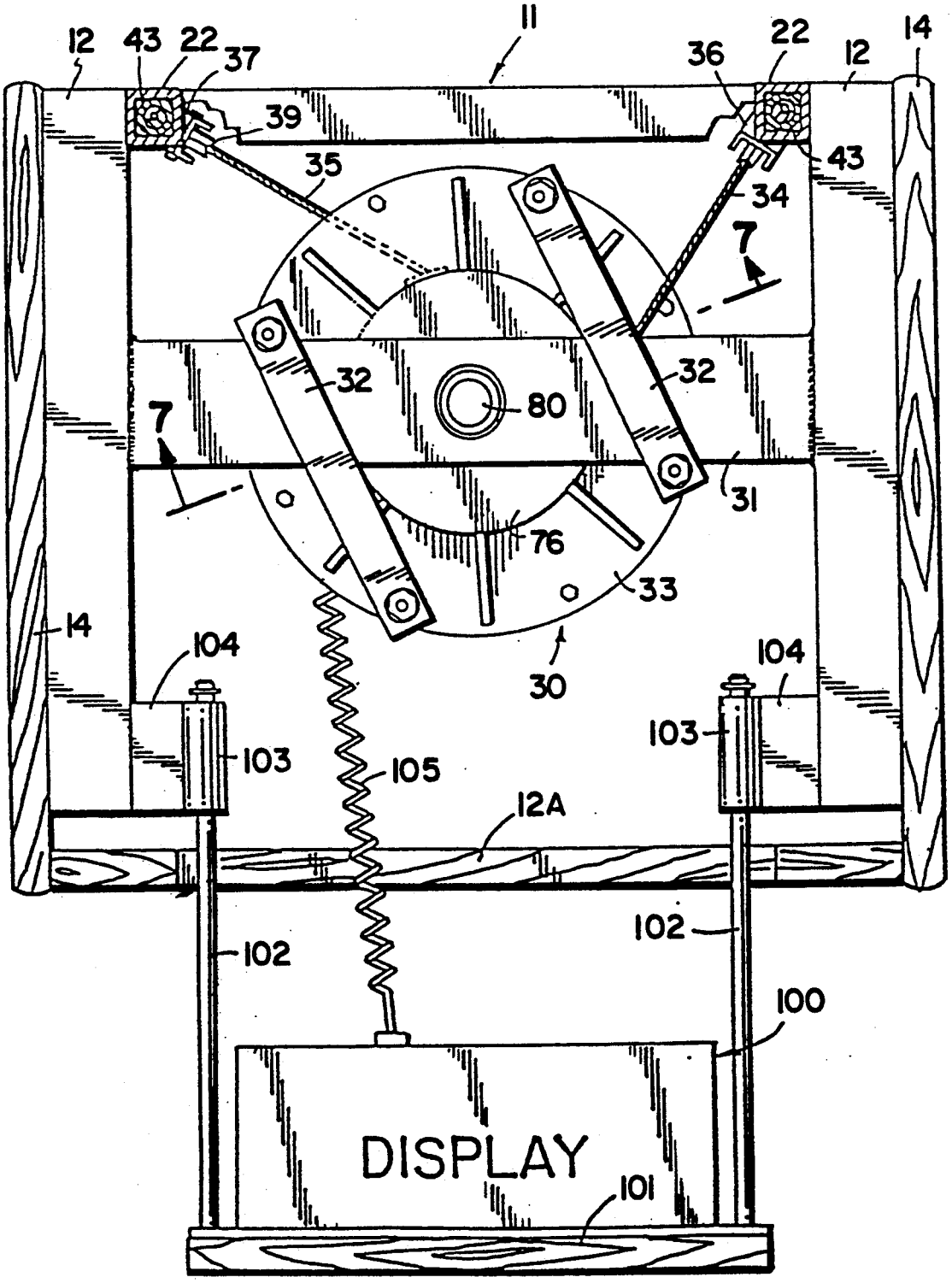
FIG. 6 is a top plan view of the chair frame, with the seat cushion removed, and showing a display panel for exercise related information in its usable position.
Figure 7:
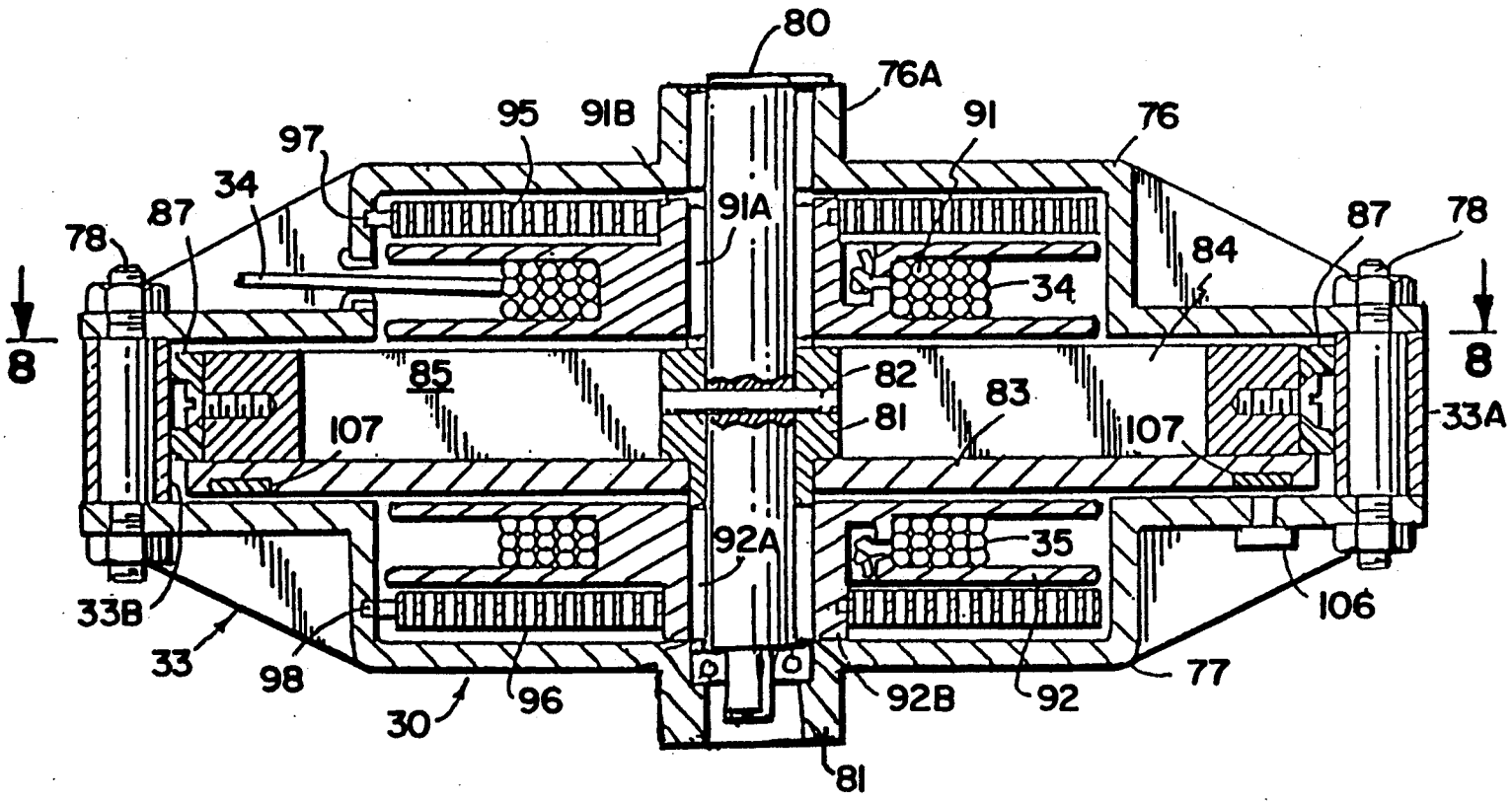
FIG. 7 is an enlarged sectional view of an exercise resistance force loading device of the present invention taken on line 7—7 in FIG. 6.
Figure 8:
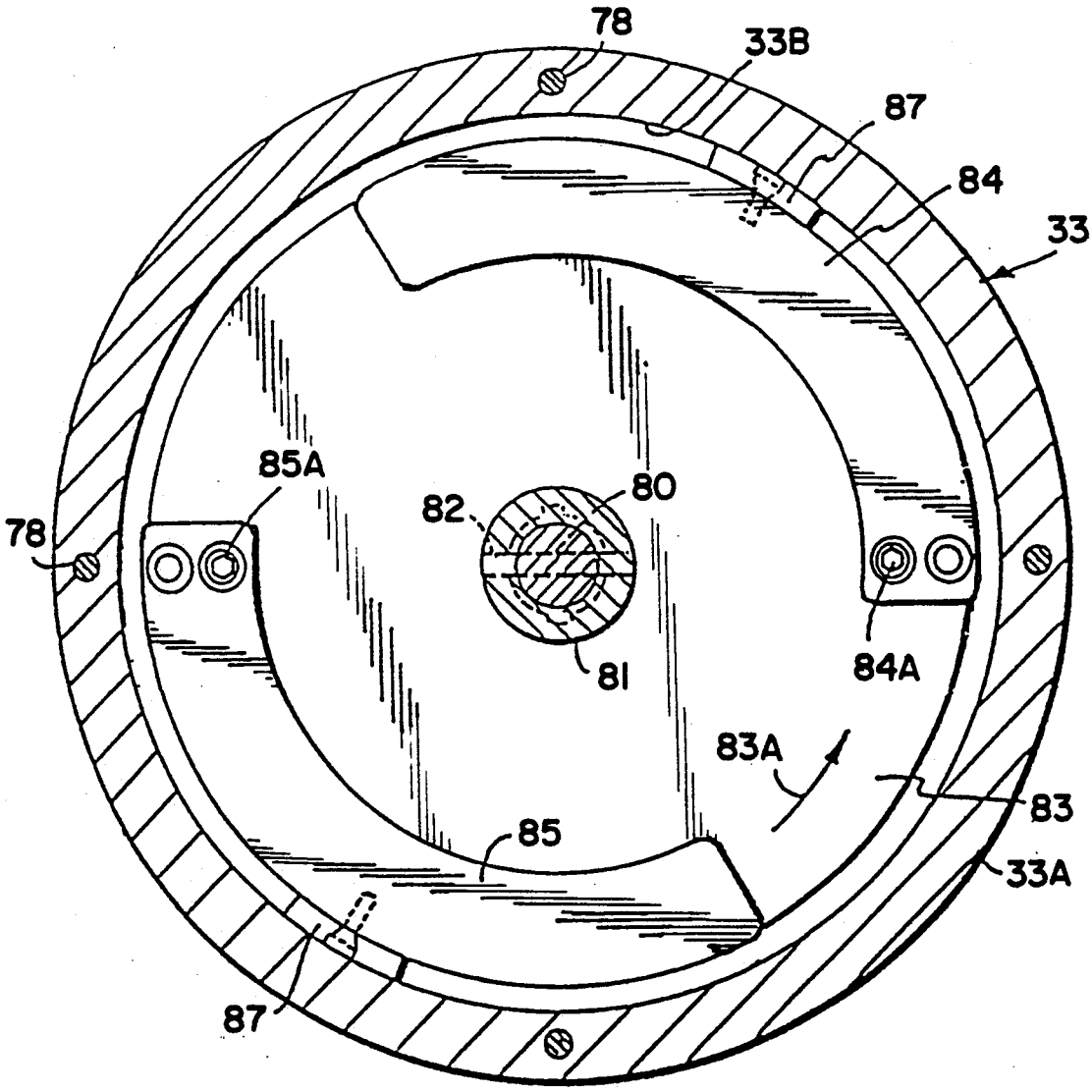
FIG. 8 is a sectional view taken generally on line 8—8 in FIG. 7.

The resistance force generating or loading device, which forms an important part of the invention, is illustrated generally at 30 in FIG. 3, and also is shown in greater detail in FIGS. 6, 7 and 8. The resistance force generating device is supported onto a rigid cross frame member 31, which is attached between the tubular steel side frame members 12. As shown, the cross frame member 31 (and other frame members) can be welded in place so that it is very rigid. The resistance force generating device 30 is a centrifugal type device, and will be more fully explained, but it is operated by rotating a rotor through pull cords or lines. The rotor is braked to generate loading forces. The pull cords or lines are made so that they will be pulled by the person exercising at differing locations in order to provide loading for the muscles of the user in a desired direction.

As shown in FIG. 6, the resistance force generating device is clamped securely onto the cross member 31 with suitable clamps 32, comprising straps that bolt on to an outer casing 33 of the resistance force generating device 30.

An internal central rotor in the resistance force generating device is rotated through the use of first and second pull cords or lines 34 and 35, respectively, that exit from the housing 33 at desired locations. The cord 34, as can be seen in FIG. 6 is adjacent a top side of the central rotor housing portion 33A, and the cord 35 is adjacent the lower side. The lines 34 and 35 are independently operable (extendable and retractable) to provide individual driving of the rotor and thus loading of the cords or lines. The cords 34 and 35 each then pass over a respective guide pulley assembly 36 and 37, as shown in FIG. 6. The guide pulley assemblies 36 and 37 are identical, except that the guide pulley assembly 36 is positioned upwardly relative to the housing to bring the cord or line 34 into proper alignment for the opening to the housing 33 of the resistance force generating or loading device 30.

Thus, only one of the pulley assemblies 36 and 37 is shown in detail, and as can be seen in FIG. 3, the pulley assembly shown is assembly 37. It includes a pulley housing 38, and a pulley 39 which is rotatably mounted onto a pin 42 on suitable bearings, so that the forces on the cord will be easily carried by the pulley 39 and the pulley can rotate easily, even under load. Pulley housing 38 is rigidly mounted onto a tube 43 which is slidably mounted in the interior of the square tube side upright frame member 22 for the back frame assembly 23. The angular position of the pulley housing 38 about the axis of the tube member 43 can be changed by releasing a set screw 45 that locks and unlocks the tube 43 relative to the frame member 22. The pulley 39 and its mounting pin 42 are positioned so that when the cord or line 35 comes from the housing 33 and passes over the pulley 39, it is aligned with the axis of the tube 43 on one side of the pulley 39. The cord or line 35 then passes up through the center passageway of the tube 43, and extends upwardly through the tubular upright frame member 22. The frame member 22 has an arm mounting housing 46 at the upper end thereof, which comprises a pair of spaced-apart parallel plates, including an outer support plate 46A, and a laterally spaced indexing-support plate 48 that is affixed to the frame assembly 23 and lies flat against the plane of the back seat cushion 25. The indexing plate 48 is perhaps best seen in FIG. 5. Indexing plate 48 is an integral part of the upright frame member 22 and the horizontal frame member 24 for the back frame assembly 23.

Figure 4:
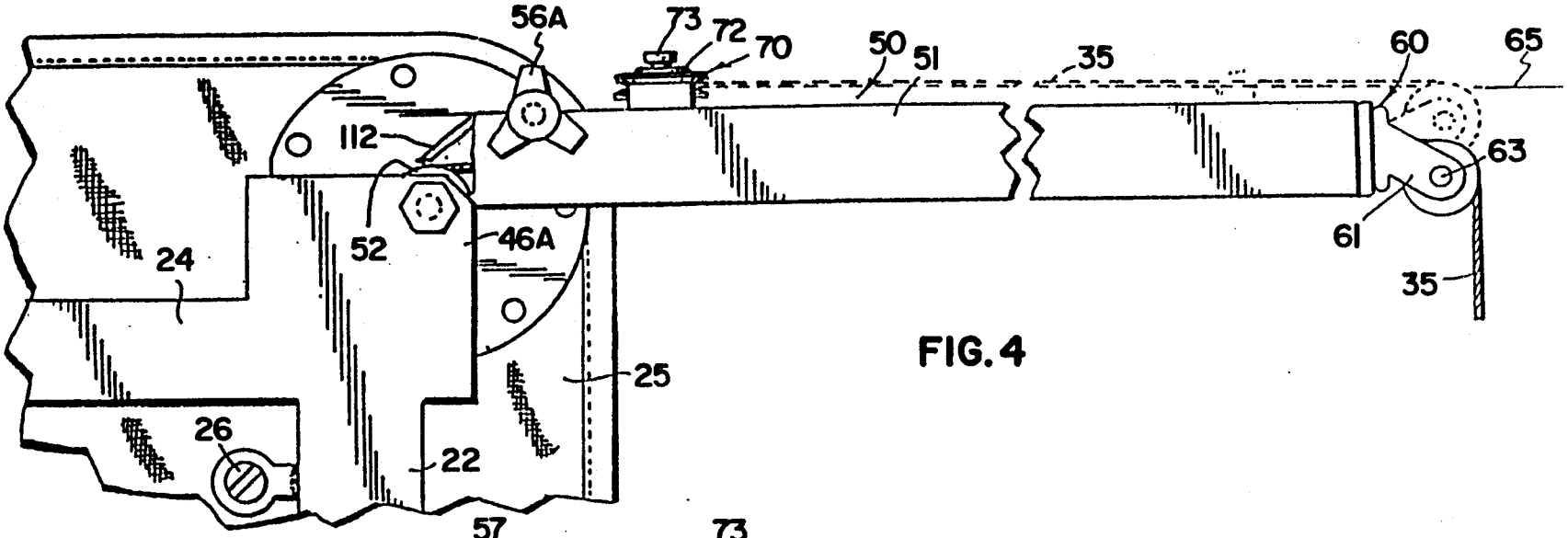
FIG. 4 is a fragmentary view of the device of FIG. 3, including an outer end portion of an exercise arm.
Figure 5:
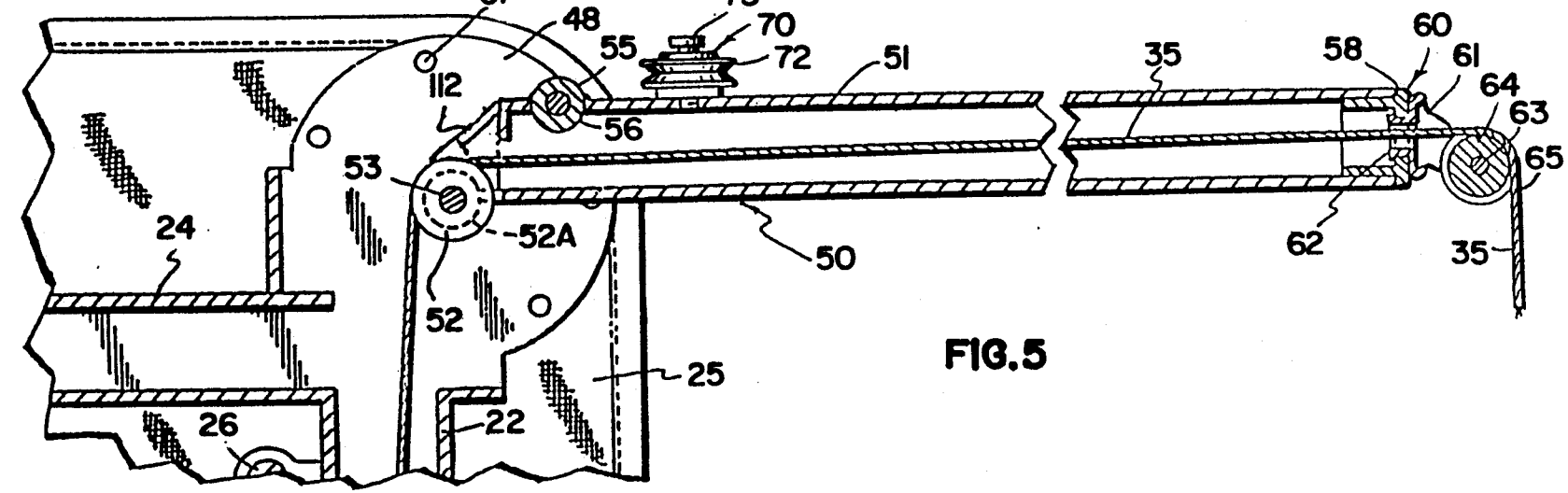
FIG. 5 is a rear view of the chair of FIG. 4 with the frame members and a support arm shown in cross section.

A pair of exercise apparatus elements comprising cord support and guide arm assemblies are mounted onto the opposite sides of the back frame assembly 23, and one such arm is shown typically in FIGS. 4 and 5. Again there is an identical arm, which is a mirror image of the arm shown in FIG. 4 and 5, on the left hand or opposite side of the chair frame.

The exercise cord support arm assembly 50 comprises a tubular arm portion 51 that is preferably a square or rectangular cross-sectional tube, which has a support hub 52A fixedly mounted thereon at one corner of an inner or pivot end of the arm 51. The hub 52A is supported on a pivot bolt 53 that in turn is fastened between the support plate 46A and the indexing plate 48. Pivot bolt 53 can have suitable bushings and mounts a pulley 52 on the pivot axis of the arm, which is a generally horizontal, fore and aft axis. The arm 51 also has a indexing pin hub 55 welded to the upper wall thereof. The hub 55 is of size to receive a springloaded indexing pin 56 that is spring loaded with a spring held inside an enlarged bore in hub 55 which bears on a stop on the pin to urge the indexing pin 56 inwardly toward the indexing plate 48. The indexing pin 56 is on the same radius from the axis of pivot bolt 53 as a plurality of index holes 57 formed near the periphery of the indexing plate 48. As shown, there are five such indexing holes, but there could be more or less as desired. The indexing pin 56 is shown in position to hold the arm 51 in a generally horizontal orientation which will place the loading lines or cords spaced laterally of the person exercising and permit butterfly exercises by such person seated on the chair.

The outer end of the arm 51 has a hub 58 on which a caster pulley assembly 60 is mounted. The outer end castering pulley assembly 60 has a pulley housing 61 that has a caster neck or spindle 62 that is rotatably mounted in the hub 58 for rotational or castering movement about the central longitudinal axis of the arm 51. The pulley housing 61 has a pair of flanges supporting a pin 63 on which a pulley wheel 64 is rotatably mounted, using suitable bearings. The line or cord 35 is threaded through an opening in the neck or spindle 62, and goes over the pulley wheel 64. The pulley wheel 64 is a castering guide pulley. As can be seen, the pulley 52 guides the cord 35 upwardly through the hollow upright frame member 22 and into the interior of the arm 51.

The pin 63 for the pulley wheel 64 is mounted on the pulley housing 61 with respect to the arm 51, so that the support surface of the pulley, wheel periphery, which supports the line or cord 35, extends to the exterior of the plane 65 of the outer surface of the arm 51 (FIG. 5). This means that the line or cord 35 can be guided back in toward the inner end of the arm 51, if desired, and the cord will clear the outer surface of the arm, as shown in dotted lines in FIG. 4. The line 35 can be threaded over a vertical axis pulley assembly 70 that is mounted on the upper side of the arm 51. The pulley assembly 70 includes a pulley, wheel member 72 that will receive the line. The pulley wheel 72 is rotatable about a pin 73 that is fixed to the arm. When the pulley assembly 60 is castered, it casters on the axis of the line 35 and will turn so that the pulley wheel 64 is turned upwardly and the pulley wheel 64 will guide the cord or line 35 as shown in dotted lines in FIG. 4.

The angular position of arm assembly 50 and the arm 51 can be changed by pulling the handle 56A of the indexing pin 56 so that it clears &:he indexing plate 48 and then moving the arm 51 to its desired position.

Figure 2:
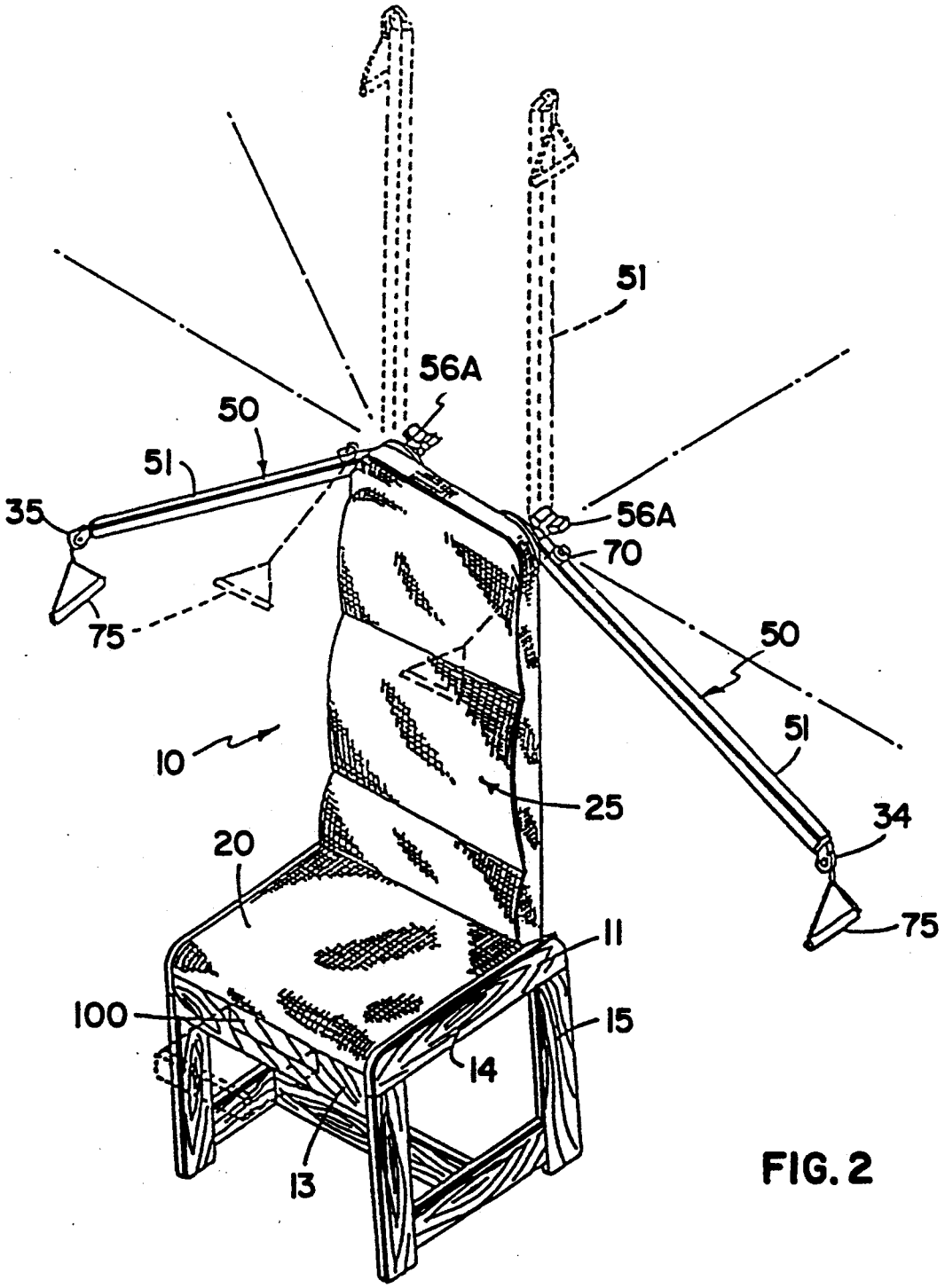
FIG. 2 is a perspective view of the chair of FIG. 1 with support arms for exercise devices shown extended into a usable position, with other positions shown in dotted lines.

The cord or line 34 is threaded into the vertical frame member 22 on the left hand side of the back frame 23 of the chair and put into the arm 51 on that side, as can be seen in FIGS. 1 and 2 in the same manner as line 35.

The outer end of each of the lines or cords 36 and 37 is provided with a handle grip indicated generally at 75, for grasping by a user, and thus upon pulling the cords using the handle grips 75, the tension load in the lines or cords is transferred to the resistance force generating or loading device 30.

The resistance force generating device 30 is independently operable by the two lines or cords 34 and 35, to drive the movable interior resistance force loading member. As shown in FIGS. 6, 7 and 8, the outer housing 33 has a central annular housing portion 33A that has end caps 76 and 77, respectively, on the top and bottom of center portion 33A. One end cap can be cast integrally with the center portion. The clamp straps 32 can be held with bolts. As shown, there are studs and bolts 78 that hold the top and bottom caps 76 and 77 onto the central housing 33A. The end caps 76 and 77 have hubs 76A and 77A that contain suitable low friction bearings for mounting a shaft 80, so that the shaft 80 is rotatably mounted in the two end caps 76 and 77 and is held axially in place. The shaft 80, in turn, drivably mounts a hub 81, which is held with a pin 82 to the shaft 80. The hub 81 is fixed to and carries a rotor disk or plate 83. The rotor 83 thus rotates whenever the shaft 80 is rotated. The rotor 83 is a brake shoe rotor that mounts a pair of pivoted, centrifugally actuated brake shoes 84 and 85, respectively. These brake shoes are pivoted on suitable pivot pins 84A and 85A to the brake shoe rotor 83 at diametrically spaced locations positioned adjacent to but within the periphery of the rotor.

The center section 33A of housing 33 forms a brake drum having an interior brake drum surface 33B, and each of the shoes 84 and 85 carries a separate brake friction pad 87 thereon. The friction pad 87 can be a relatively small pads of suitable brake shoe material held in a desired annular location on the brake shoes. The loading action of the brake shoe from inertial forces acting through the brake pads provides an adequate resistance force as the brake shoe rotor 83 is rotated. The brake shoes 84 and 85 are centrifugally actuated flywheel weights that will pivot outwardly under centrifugal force when the brake rotor is rotated. The pivot pins 84A and 85A are selected to be very low friction, to make the action of the brakes satisfactory for operation. The position of the brake pads 87 relative to the pivot pins 84A and 85A is selected to provide resistance force substantially instantly upon movement of the brake shoe rotor disk. The brake pads 87 are close to surface 33B for quick braking action as well.

The lines or cords 34 and 35 are guided into the interior of the respective end caps of the housing 33 through openings 90 in FIG. 3 and are in position to be aligned with a separate top or bottom pulley for the respective cords. A pulley 91 in end cap 76 is shown for receiving the cord 34 wrapped thereon on the top side of the resistance force generating device 30, (see FIG. 7) and a pulley 92 is positioned in the end cap 77 for the cord or line 35. The cords or lines 34 and 35 are anchored on the interior hub of the pulleys 91 and 92, respectively, and then wound onto the respective pulley so that there is an adequate length of cord exterior to desired location for carrying out the exercises desired, even when the arms 51 are arranged in different configurations from those shown in the drawings.

The pulleys 91 and 92 are drivably connected to the shaft 80 through known, quick acting, roller bearing one-way clutches 91A and 92A, respectively, that are mounted on the interior of the hubs of the pulleys. The one-way clutches 91A and 92A thus are made so that they will drive the shaft 80 when the cords or lines 34 or 35 are extended or pulled out. Any extension of either cord will immediately cause the brake shoe rotor disk 83 to start to rotate in direction as indicated by arrow 83A in FIG. 8, and when a certain RPM is reached, causing the brake shoes 84 and 85 to pivot outwardly and cause the friction brake pads 87 to engage the inner surface 33A of the housing or drum 33 and create a resistance force to resist e>:tension of one of the cords 34 or 35 (or both), that is proportional to the force being applied to the respective cords. The speed of rotation of the rotor disk 83 will tend to increase as more force is applied to the handgrips 75 and lines or cords 34 and 35.

The pulleys 91 and 92 are free to rotate relative to shaft 80 in an opposite direction relative to the shaft 80 due to the one-way clutches, to retract the respective lines or cords 34 and 35. Long, flat coiled torsion springs 95 and 96 are used for retraction of long lengths of the cords 34 and 35 without great increase in the retraction force. The springs 95 and 96 are coiled around hub portions 91B and 92B on the pulleys 91 and 92, respectively. One end of each long spring is anchored to the respective hubs 91B and 92B and the other end of each flat spring, at its outer periphery, is anchored as at 97 and 98, respectively, to the wall of the respective end cap 76 and 77. The flat springs 95 and 96 are fairly low force, but are also fairly uniform force as the coil changes in size. The torsion springs will wind up (tighter) as the cords 34 and 35 are extended and then when the cords are unloaded or released, the springs 95 and 96 will exert a force to rewind or retract the cords onto their respective pulleys. Thus, repeated cycling can take place with the cords being retracted each time the load on a cord is released or reduced sufficiently.

The resistance force generating or loading device is thus speed sensitive, and will provide a greater resistance to extension of the cords as the speed of removal of the cords increases. The speed of removal of the cords will be proportional to the forces exerted on the hand grips, and thus if a rapid pull is attempted, a greater force will be exerted by the resistance force generating device 30 because of the greater centrifugal force on the brake shoes 84 and 85 and thus the greater frictional force between the respective pads 84A and 85A and the inner surface 33B. The amount of force that is used in the exercise can be automatically controlled and compensated. The springs 95 and 96 do not add a significant amount of overall force to extension of the cords.

If desired, a light coil spring can be used to tend to bias the respective brake shoes 84 and 85 inwardly about their pivot pins 84A and 85A so that there will be no friction load from the brake pads 87 upon slow outward movement of the cords 34 or 35. The resistance load will only be from the retraction springs until the rotor rotates at a sufficient speed. If the pivots 84A and 85A are quite friction free, the resistance load will pick up very rapidly.

The display panel of indicators and the like is shown at 100 in FIG. 6, and can be any desired type of display for displaying speed of rotation of the rotor or sensing and displaying the resistance force generating or loading device, and can actually be calibrated to display the amount of force being generated. Other displays can be counters for counting the number of times the cords 34 and 35 are cycled, using suitable sensors, such as optical or magnetic sensors. The display indicated at 100 is mounted on to a support frame 101 that has a pair of sliding rods 102, which are in turn mounted for sliding in hubs 103. The hubs 103 are affixed to the chair frame members 12 with suitable supports 104. The front end of the movable display can be blended into the front wooden cross member on the wood frame, as can be seen in FIG. 1. As shown, the display is coupled with a cord 105 to a sensor 106 (see FIG. 7) that is a magnetic type sensor to sense the passage of magnets 107 that are embedded in the brake shoe rotor disk at 83. The magnets 107 can be closely spaced around the brake shoe rotor disk to insure detecting rotation almost as soon as the cords 34 or 35 are extended at all. This car provide a speed count, which is proportional to the force being generated and can be calculated. This type of sensor 106 is only one type that can be utilized with the present device and is provided for illustrative purposes.

It can be seen with the arms 51 generally horizontally positioned, as shown in FIG. 5, that butterflies and reverse butterfly exercises can be conducted by a person seated on the chair, and as generally illustrated in FIG. with the arms 51 downwardly in the solid line position, a type of bench press exercise can be carried out by pushing the handles 75 forwardly generally parallel to the chair seat. Additionally, pushups can be done with the arms 51 positioned at the next station lower than that shown in FIG. 2 so that the outer ends of the arms are closer to the sides of the chairs. Then the handles 75 can be grasped and pushed straight up by the user. Curls can also be performed with the arms 51 in the lowered position, and pull downs can be achieved with the arms in the position shown with the dotted lines in FIG. 2.

With the arms 51 in any one of the indexed positions, and with the cords threaded around the pulley assemblies 70, the handles 75 can be positioned close to the lateral sides to the chair back, generally as shown in FIG. 2, to provide different types of exercises for the upper body. A type of chest press can be performed. With pulleys mounted onto the frame of the chair as shown in dotted lines at 110, and the arms lowered from that shown in FIG. 2, curls can be performed.

In FIG. 9, a modified for of the invention indicated generally at 120 is shown which provides for a different frame construction, and includes contoured type cushions. In this form of the invention, a frame 121 has an outer wood frame assembly 12, which includes horizontal top sections 123 that will attach to a main load-carrying frame section, and vertical legs 124A and 124B. The legs 124B slope rearwardly, as shown, and a bottom fore and aft extending support 125 is attached to the lower ends of these legs. The frame assembly 122 supports the exercise device.

Figure 10:
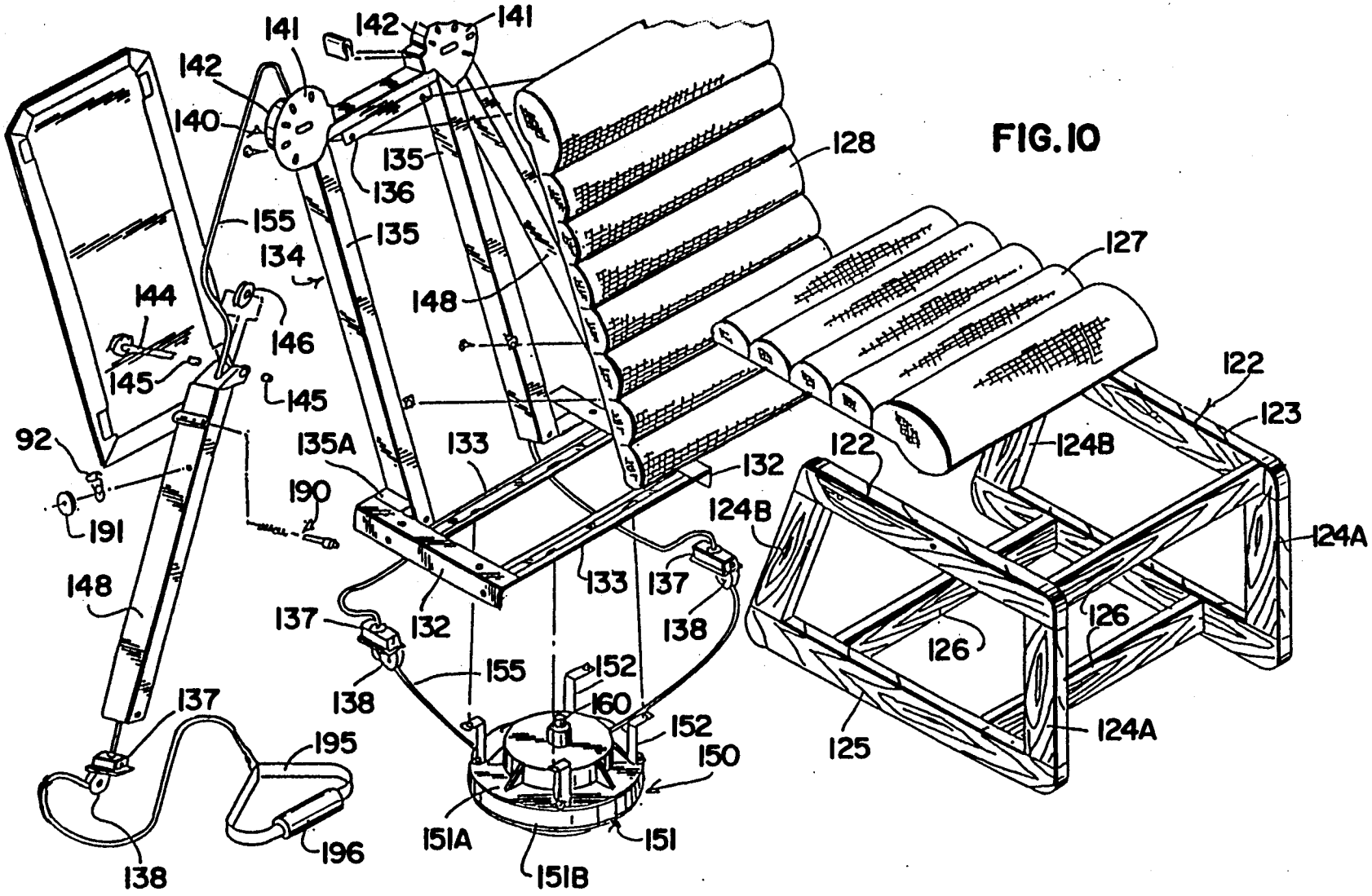
FIG. 10 is an exploded perspective view of the embodiment illustrated in FIG. 9, showing frame details.

As can be seen in FIG. 10, the top and bottom members of assembly 122 are held together with suitable cross members 126. A seat cushion 127 is provided on the chair, as well as contoured back cushion 128, as shown, which can be padded in any suitable manner. In this form of the invention, the frame assembly 121 shown in FIG. 10 includes a unitized load-carrying frame 130 to which the frame 122 of suitable wood construction is connected. The frame 130 includes a horizontal seat support assembly 131 which has angle cross section side members 32 that are fabricated for weight reduction, and the side members 132 are held together with suitable channel section members 133, 133 that are spaced in fore and aft directions and are securely attached (welded) to the side members 132. A back frame 134 is made up of tubular side members 135, as shown in the first form of the invention, through which pull ropes or cords will extend as previously shown. A top cross member 136 joins the side members 135 together.

In this form of the invention, the back cushion attaches directly to the cross member 136. The back frame 134 has swivel pulley assemblies 137, 137 which are made to slip into the lower ends of the rectangular tube upright members 135 to provide guides for the exercise cords through swivel pulleys 138. The same swivel assembly 134 is used at &;he outer ends of the folding arms as will be shown. At the upper ends of the vertical or upright frame members 135 for the back frame, indexing arm support plate assemblies 140 are mounted. As shown, these are slightly modified from the first form of the invention, but include an index plate 141 on each side of the back, and a spaced-apart support plate 142 which together define a space into which an arm support hub 143 can be placed and mounted on a suitable pivot pin 144 through suitable bushings 145. The hub 143 is bifurcated, and between the side members of the hub a pulley 146 is rotatably mounted on each of the pivot pins 44. The arm members indicated at 148 are again rectangular tubular members, and at the outer ends of each of these tubular arm members a castering or swivel pulley assembly 137 is mounted with castering pulley 138 thereon.

In this form of the invention, the resistance force generating device indicated at 150 (see FIGS. 10, 11 and 12) functions in the same manner as that illustrated in the first form of the invention, but includes certain weight reduction and housing improvements, and is mounted to the horizontal frame 131 in a different manner. The resistance force generating device 150 has an outer case assembly 151 that is supported through stand-off brackets 152 to and below the cross members 133. The cross members 133 are channel shaped for rigidity and lighter weight. Suitable cap screws or bolts are used to securely fasten the case assembly 157 in place. The opposite ends of the stand-off brackets 152 are securely mounted with cap screws and bolts to the outer housing 151, using the cap screws or bolts which hold the two parts of the housing together.

Figure 11:
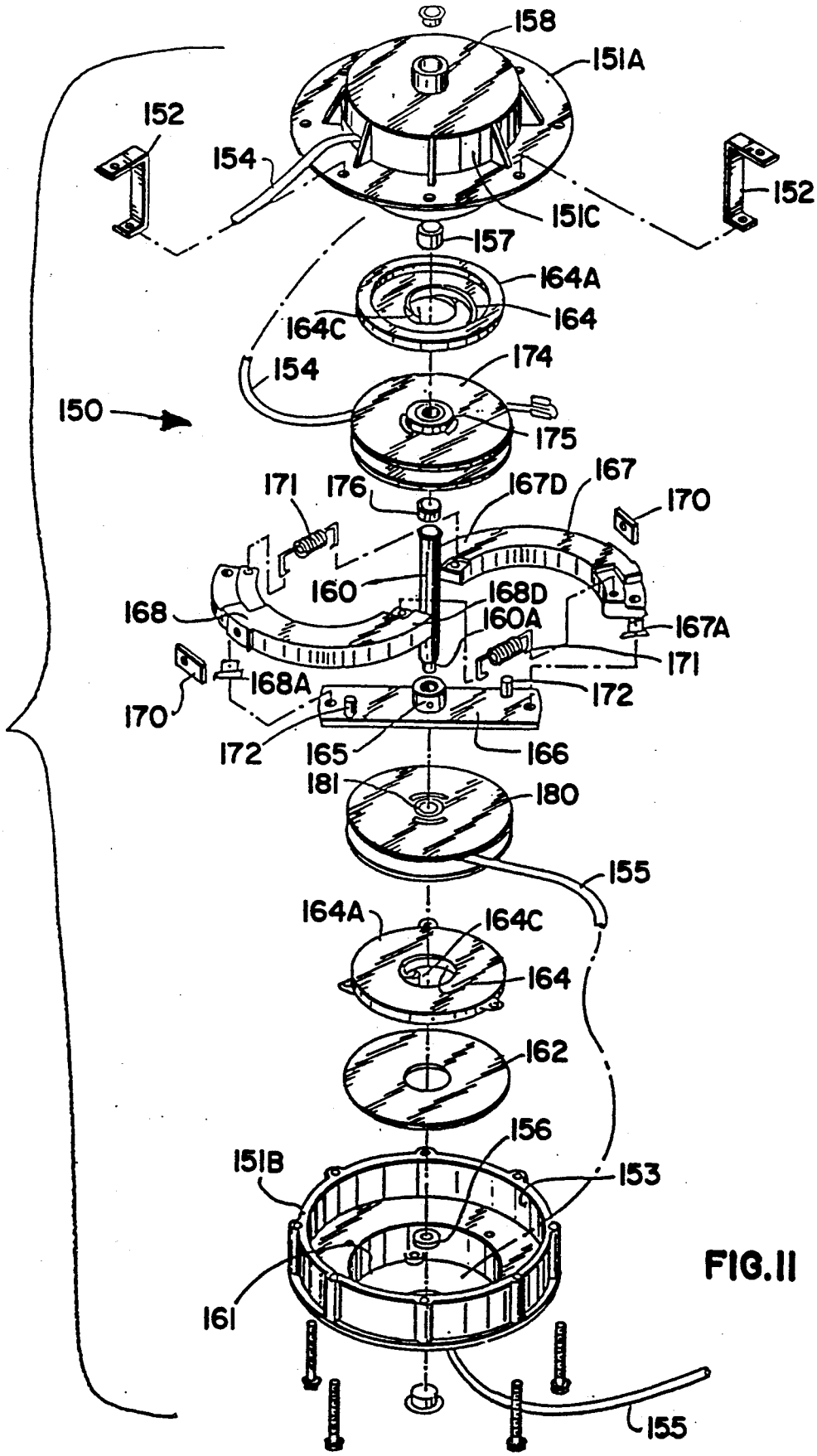
FIG. 11 is an exploded perspective view of a force resistance device shown in the embodiment of FIG. 9.
Figure 12:
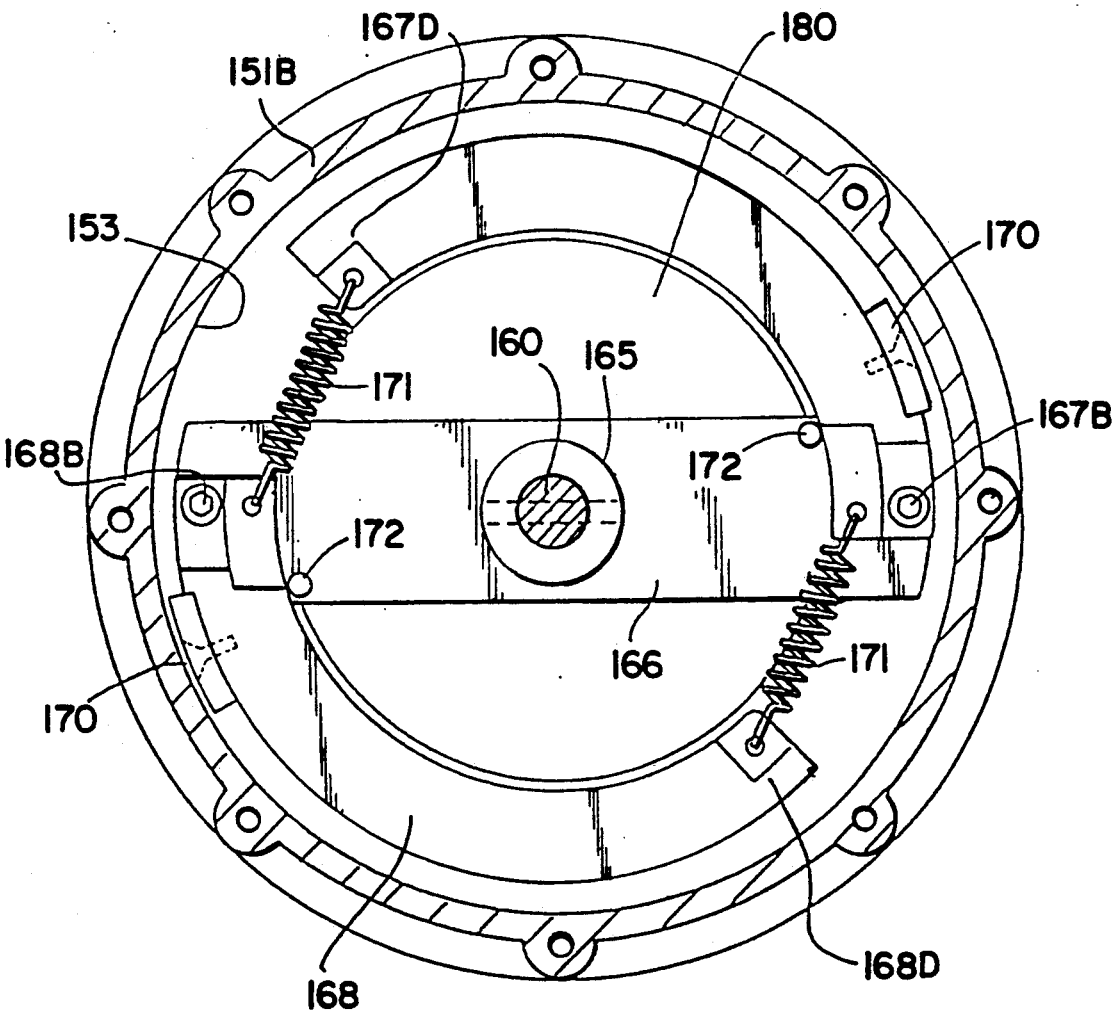
FIG. 12 is a sectional plan view of the force resistance device shown in FIG. 11.

In FIGS. 11 and 12, the construction of the resistance force generating device 150 is illustrated in more detail. As stated previously, the resistance force generating device operates in substantially the same manner as in the first form of the invention. The outer housing or casing 151 has an upper housing portion or cap 151A, and a single lower housing section 151B, as shown in FIG. 11. The lower housing portion 151B includes the brake drum center portion integrally cast to the lower cap, and has an inner surface 153 against which the friction brake pads will operate.

The internal brake shoe rotor of the force generating device 150 is operated (or rotated) through the use of first and second pull cords or lines 154 and 155, respectively. The cords or lines 154 and 155 are mounted in upper and lower pulley assemblies, respectively, and are suitably guided over the respective pulley 138 and up through the associated vertical or upright frame member 135. As can be seen, the left frame member 135 will be slightly lower at its lower end to position that associated pulley 138 to align with the exit of the cord 155 from housing 151, for proper guidance. The cord 155 is also shown in FIG. 10.

As shown in FIG. the lower housing portion 151B that includes the internal brake drum having surface 153 will support the cap 151A at the top. Each of the lower housing portion 151B and the top or upper housing portion or cap 151A has a hub that mounts a bearing for a central drive shaft 160. A roller bearing 156 is mounted in the lower housing portion, as shown in FIG. 11, and a needle bearing 157 is mounted in the hub 158 of the upper housing portion or cap 151A. The shaft 160 has a shoulder 160A that rests on bearing 156. In this form of the invention, the lower housing portion has a spring recess or pocket 161, that has an antirattle disk 162 at the bottom surface thereof. A cord retraction spring assembly 163 is mounted in this pocket 161 of the lower housing, as previously shown in the first form of the invention. However, the o retraction spring 164 is inside a housing or carriage 164A. The housing 164A is made so that the spring will not fly out, and it is more easily retained if the resistance force generating unit is disassembled. A housing 164A is used in a recess formed by upper housing end portion 151C. The retraction springs are flat springs, as previously explained, and each spring has one end anchored to the respective horsing or container 164A. The housings 164 in turn are fixed to the respective outer housing portion 151A or 152B at the end walls of the housing.

The central shaft 160 is drivably mounted to a hub 165 of a brake rotor 166, which comprises a rotor plate or disk. As shown, it is a strap that forms a brake shoe rotor plate which mounts a pair of pivoted, centrifugally actuated brake shoes 167 and 168, respectively. The shoes are pivotally mounted with suitable low friction bushings 167A and 168A, respectively, and then the bushings a:.e in turn held in place with suitable pins or bolts 167( and 168B back to the brake disk rotor 166.

The hub 165 is drivably coupled to the shaft with suitable set screws in the hub, that act against the shaft. The shaft can have other types of retainers, if desired. In the resistance force generating device, the brake shoes 167 and 168 are aligned with the brake drum surface 153, and have brake pads 170, 170 mounted in suitable portions of the brake shoes adjacent to the pivot pins. The brake shoes in turn are also urged inwardly with light tension springs 171, 171 that act to hold the outer or free ends shown at 168D and 167D of the brake shoes inwardly. This will prevent brake force from initially being present when the rotor is rotated at a slow speed, and the retraction springs that were shown at 164 will provide a load as the cords are extended, as will be explained. The brake rotor has stop pins 172 that limit the inward pivoting of the brake shoes.

The cord !54 is mounted and wound on an upper cord pulley assembly 174, and it is guided through a suitable opening in the upper housing section 151A to align with the pulley when it is in position on the shaft 160. The pulley 174 has a central hub 175 in which a suitable one-way clutch shown at 176 on the interior of the hub 175 is mounted. This one-way clutch is drivably mounted in the hub 175, and will cause the pulley 174 to drive the shaft 160 when the cord 154 is extended from the housing 151, but will permit freewheeling of the pulley 174 relative to the shaft 160 in the opposite direction of rotation.

The pulley hub 175 also has an attachment device for attaching the free end 164B (inner end) of the associated spring 164, so that when the pulley 174 is rotated, the flat, coiled spring 164 will be tightened to provide a retraction spring force on the pulley 174. When the cord 154 is not under load from exercising, the pulley 174 will be rotated by the spring force and freewheel relative to the shaft 160 to retract the cord.

Line 155 is mounted onto e cord pulley 180 which provides for adequate cord storage when the cord is wound thereon between side flanges. The pulley 180 also has a hub with a central bore in which a one-way clutch 181 is mounted. The pulley has a lower hub end that is identical to the hub end 175, but which is not shown in FIG. 11, that is used for connecting to the inner end 164C of the associated spring 164, so that when the cord 155 is extended, the one-way clutch in the bore 181 will drive the shaft 160, in the same direction of rotation as the driving force on the cord 154, causing the shaft 160 to rotate and, of course, the brake rotor 166 to also rotate so that when a certain speed is exceeded, the brake shoes 167 and 168 will move outwardly under centrifugal force and cause the brake shoe pads 170 to engage the surface 153 and provide a resistance force.

The retraction spring 164 that is associated with the pulley 180 will be tightened as the cord 155 is extended. The cord 155 extends through a suitable aperture in the lower housing section 151B, as shown in the previous form of the invention. When the cord 155 is released, after being extended during exercise, the retraction spring 164 for the pulley 180 will rotate the pulley to retract the line or cord 155 and the one-way clutch in the bore 181 will permit this retraction without driving or dragging on the shaft 160. The inner ends of the cords 154 and 155 are suitably attached to the inner hubs of the pulleys 174 and 180, respectively, in a known manner between the side flanges of the pulleys. Likewise, the outer ends of the springs 164, as stated, are anchored to the housings 163, which, in turn, were anchored to the housing sections 151A and 151B.

The resistance force generating device 150 is speed sensitive, and the more rapidly the cords 154 and 155 are extended, as previously explained, the greater the resistance force that will be generated. The cords 154 and 155 are guided out of the resistance force generating device 150, over the respective pulleys at the lower ends of frame members 135. The cords extend up through frame member 135 and then river pulleys 146 t the outer ends of the respective arm.

As can be seen in FIG. 10, the cords 154 and 155 will pass out through the respective arm 148 to the outer ends and out over pulleys 138 for use. The arms 148 can be indexed to a desired position about their pivots using a spring loaded index pin assembly indicated generally at 190 to index relative to the plate 141, as shown in the first form of the invention. The cord pulleys !38 will caster relative to their supports formed by part of the assembly 137 that attaches to the ends of the arms 148, so that the cords will be guided to the exterior of the upper surface of the arms, and then can be guided over pulleys 191 that are attached to the arms near the are inner ends. In this form of the invention, a suitable spring cord retainer 192 can be placed below the pulley 191 before the pulley is rotatably mounted with a fastening bolt 193, to provide for a retainer for the cords 155 and 154, respectively. This type of spring retainer is shown in FIG. 13. It will permit the cords to be brought in from the outer end pulleys 138 on the arms adjacent to the back rests, for doing exercises with the cords in this location.

As also shown in FIG. 10, the outer ends of each of the cords 154 and 155 can lave a strap type handle assembly 195, that has a hand grip 196 of soft material that forms a roll that goes around the straps 195.

The arms in the second form of the assembly can be pivoted to be horizontal, angled up or down, and held vertically upwards. Thus, all types of exercises explained in connection with the first form of the invention can be carried out. The arms 148 can be retracted to be within the perimeter of the back cushion of the chair and will rest down alongside the vertical frame members 135, 135 in a stored position. There is a spacer block shown at 135A that offsets the upright members or vertical members 135 inwardly from the frame members 132, to provide for a space for storing the arms.

It should be noted that the pulley 52 at the pivot pin 53 have a guide to keep the cords in position on the pulleys during normal operation.

Thus, isokinetic exercises can easily be achieved because the resistance force of the resistance force generating device 30 or 150 will increase to match the force applied to the handle grips 75, through the cords or lines 34 and 35 or 154 and 155. No external adjustments are required as strength increases, as the operator becomes more fit, or with a change of operators. No large Weights are lifted to provide resistance. Weights can fall or cause a muscle strain. The resistance stops as soon as the applied force to the cords or lines is removed.

The furniture styling of the chair can be made to be simple and non-detracting. It is a side chair when not in use as an exerciser. The chair will convert quickly to an exercise chair. If desired, fabric and wood trims can be selected to please the user.

The quick change of the exercise elements comprising cord support arms using the indexing plates and indexing pin for moving the arms 51 or 148 about their pivots provides an effortless changeover between exercises. The arms 51 and 148 are retractable for storage to be within the lateral width of the back of the chair, and within the periphery of the chair vertically. The protrusion to the rear is minimized and actually is not much greater than the protrusion of the rear legs where are they are supported on the floor, in a normal chair construction.

While pivoting arms which fold downwardly for storage are disclosed, the arms could fold back onto themselves about pivots, or they could be made to retract by sliding or telescoping horizontally behind the chair back. Various supports for the horizontal arms thus can be made relatively easily. Retraction of the arms is not limited to the pivoting motion shown.

The electronic panel on the readout can be LED readouts, to digitally show the pounds of pull and also be set to provide a signal when a desired load is reached. The sensor 106 can provide a count of the number of repetitions to ensure that a complete exercise program is being followed.

The term "line" includes wire cables, cords, ropes and other equivalent elongated flexible members.

Although the present invention has been described with reference to preferred embodiments, workers skilled in the art will recognize that changes may be made in form and detail without departing from the spirit and scope of the invention.

What is claimed is:

1. A convertible exerciser, comprising:

(a) a seat;

(b) frame means to support said seat above a surface;

(c) an upright back frame connected to said sheet;

(d) an operable exercise support including at least one arm portion having an inner end and positioned to the rear of said upright back frame, said at least one arm portion being moveable from a generally horizontal position extending laterally from said frame means to a position at the rear of said upright back frame and within a perimeter area defined by said upright back frame; and (e) load resistant line means mounted relative to said at least one arm portion and operable to apply a resistance load upon outward movement of said load resistant line means relative to said at least one arm portion.

2. A chair comprising a seat, frame means for supporting said seat above a surface including an upright back frame, said back frame being positioned to support the back of person seated on said seat, a loading device operable to apply a drag on a movable element forming part of said loading device, said loading device being mounted on said frame means beneath the planform of said seat and above said surface on which the chair is supported, flexible line means connected to said movable element of said loading device, and an operable exercise frame element including at least one retractable arm portion mounted to a portion of said frame means of the chair and movable between a storage position wherein said arm portion is concealed behind said upright back frame, and an exercise position wherein said arm portion extends outwardly from the chair, said line means being mounted to be guided on said retractable arm portion so that upon movement of said line means away from said loading device, said movable element of said loading device is moved and said line is loaded.

3. The chair of claim 2 wherein said retractable arm portion is positioned to the rear of said back frame of the chair, and a first pulley rotatably mounted at an inner end of pivoting of said arm portion adjacent said back frame for carrying and guiding said flexible line means.

4. The chair of claim 3 wherein said arm portion comprises a tube, said flexible line means passing within an interior space defined by said tube from said inner end to an outer end.

5. The chair of claim 2 and a pair of retractable arm portions pivotally mounted to said back frame of the chair about laterally spaced, generally horizontal axes that extend in fore and aft direction, said retractable as portions both being selectively movable from retracted, storage positions wherein said retractable arm portions extend generally-downwardly to a plurality of operable positions extending laterally from said back frame of the chain, including positions with both retractable arm portions extending generally horizontally outwardly from the respective opposite sides of said back frame of the chair, and means to selectively fix said retractable arm portions in each of said plurality of adjusted positions.

6. The chair of claim 2 wherein said movable element of said loading device comprises a rotatable centrifugal force sensitive, force generating brake member that provides a resistive force proportional to the speed of rotation of said brake member.

7. The chair of claim 6 wherein said flexible line member is wound around a loading pulley on said loading device, said loading pulley being drivably connected to said rotatable force generating member through one-way clutch means, and spring means for retracting said flexible line member onto said loading pulley when said flexible line member is unloaded.

8. A chair comprising a seat, frame means for supporting said seat above a surface including an upright back frame, said back frame being positioned to support the back of a person coated on said seat, a loading device operable to apply a drag on a movable element forming part of said loading device, said loading device being mounted on said frame means beneath said seat and above said surface on which the chair is supported, flexible line means connected to said movable element of said loading device, and an operable exercise frame element including at least one retractable arm portion pivotally mounted at its inner end to the rear of said back frame of the chair and movable to a position wherein said arm portion extends outwardly from the chair, said line means being mounted to be guided on said retractable arm portion so that upon movement of said line means away from said loading device, said movable element of said loading device is moved and said line is loaded, and a first pulley rotatably mounted at the pivot axis of said inner end of said arm portion adjacent said back frame for carrying and guiding said flexible line means, and means to adjustably fix said arm portion at a plurality of positions about the pivot axis, including a storage position wherein said retractable arm portion is laterally within the space defined by said back frame of the chair.

9. A chair comprising a seat, frame means for supporting said seat above a surface including an upright back frame, said back frame being positioned to support the back of a person seated on said seat, a loading device operable to apply a drag on a movable element forming part of said loading device, said loading device being mounted on said frame means beneath said seat and above said surface on which the chair is supported, flexible line means connected to said movable element of said loading device, and an operable exercise frame element including at least one retractable tubular arm portion positioned to the rear of said back frame of the chair and movable to a position wherein said arm portion extends outwardly from the chair, said line means being mounted to be guided on a first pulley rotatably mounted at an inner end of pivoting of said arm portion adjacent said back frame and to pass within an interior space defined by said retractable tubular arm portion from said inner end to an outer end, and a second pulley at said outer end of said retractable tubular arm portion comprising a castering pulley that casters about a castering axis generally parallel tot he longitudinal axis of said retractable tubular arm portion and parallel tot he axis of said line extending within said retractable tubular arm portion, and having a pulley wheel which rotates on an axis perpendicular to the castering axis, and said second pulley being of size to guide said flexible line means from said outer end of said retractable tubular arm portion to a position clearing an outer surface of said retractable tubular arm portion when said flexible line means is doubled back on the exterior of said retractable tubular arm portion, and a third pulley mounted on the exterior of said retractable tubular arm portion adjacent said inner end thereof and positioned on said retractable tubular arm portion laterally outwardly from said back frame of the chair when said retractable tubular arm portion is extending laterally of said back frame, whereby said flexible line means is guidable out of said outer end of said retractable tubular arm portion, around said second pulley, back toward said inner end of said retractable tubular arm portion, and then guided by said third pulley forwardly to positions permitting a person seated on said seat to pull forwardly on said flexible line means to cause movement of said movable element of said loading device.

10. A convertible exerciser comprising frame means to support a seat above a surface, an upright back frame connected to said seat, a loading device carried by said frame means beneath the planform of said seat, and operable to apply a resistance load when loaded, line means connected to said loading device whereby upon outward movement of said line means said loading device provides a resistance force to said line means, an operable exercise support including at least one arm portion mounted to a portion of said frame means and movable between a storage position wherein said arm portion is concealed behind said upright back frame, and an exercise position wherein said arm portion extends laterally from said frame means, and guide members mounted on said frame and arm portion, said line means being mounted relative to said guide members so that upon movement of said line means in a direction away from said loading device said line means is moved and said loading device is operated.

11. The convertible exerciser of claim 10 wherein said frame means comprises a chair including said seat adjacent said back, and said seat and said back are continuous and have cushions and outer molding members thereon to define a piece of furniture.

12. The convertible exerciser of claim 9 and means for mounting said loading device beneath the planform of said seat.

13. The convertible exerciser of claim 12 and a pair of arm portions pivotally mounted to said back frame and separate line means associated with each arm portion and with said loading device, said pair of arm portions being laterally spaced apart and each being adjacent one of a pair of side edges of said back frame, said arm portions being pivotally movable from generally horizontal positions to positions to the rear of said back frame where said arm portions extend substantially downwardly, and means to selectively fix each of said arm portions in a plurality of pivoted positions.

14. The convertible exerciser of claim 13, wherein said back frame includes a pair of tubular upright side frame members, each of said line means being operable connected to said loading device to be loaded as said line means are extended from said loading device, said arm portions also being tubular and the respective line means being guided outwardly from said loading device and passing over pulley means comprising a pair of said guide members provided at lower ends of each of said upright side frame members and upwardly through said upright side frame members and through said tubular arm portions, said guide members further including second pulleys mounted to rotate about the pivot axes of said arm portions and third pulleys at outer ends of said arm portions.

15. A convertible exerciser comprising frame means to support a seat above a surface, an upright back frame connected to said seat, a loading device carried by said frame means and operable to apply a resistance load when loaded, line means connected to said loadign device whereby upon outward movement of said line means said loading device provides a resistance force to said line means, an operable exercise support including at least one arm portion having an inner end and positioned to the rear of said back frame, said arm portion being retractable from a generally horizontal position extending laterally from said frame means to a position at the rear of said back frame and within a perimeter area defined by said back frame, and guide members mounted on said frame and arm portion, with said line means being mounted relative to said guide members so that upon movement of said line means in a direction away from said loading device said line means is moved and said loading device is operated.

16. The convertible exerciser of claim 15, including means to pivotally mount said arm portion to said back frame, and means to adjustably fix said arm portion at a plurality of pivoted positions about its pivot axis extending laterally from said back frame and to a position wherein said arm portion is substantially uprightly extending.

17. The convertible exerciser of claim 15, wherein said loading device includes a braking rotor, separate line pulley means for each of said line means, each line means being wound on its respective line pulley means in a retracted position, and one-way drive means operably connecting the respective line pulley means to said rotor to drive said rotor in a first direction to cause a braking load when a respective one of said line means is extended.

18. The convertible exerciser of claim 17 and spring means for retracting said respective line means onto the associated line pulley means when load is released from said line means.

19. An exercise chair comprising a seat, a frame to support said seat above a surface, said frame including an upright back frame positioned to support the back of a person seated on said seat, a resistance force generator device positioned beneath the planform of said seat, said resistance force generator device comprising a rotatable disk and brake, a pair of flexible lines connected to rotatable pulleys to cause rotation of said disk when one or the other flexible line is extended, said brake being actuated upon rotation of said disk to provide frictional resistance to extension of said flexible line means, an operable exercise frame carried by the chair including a pair of retractable arms movably mounted to a portion of said frame of the chair and each arm being movable between a storage position wherein each arm is concealed behind said upright back frame, and an exercise position wherein each arm extends outwardly from the chair, means mounted on each arm for guiding a respective one of said flexible lines to outer ends of said respective arm so that said lines are spaced from each other and positioned to be moved by a person seated on said seat, and whereby when either of said lines is moved said resistance force generating device is moved to cause a brake load on said respective line.

20. The chair of claim 19 wherein said arms are pivotally mounted at inner ends thereof to said frame about generally horizontal pivot axes, and are positioned to the rear of said upright back frame of the chair, and said means for guiding comprising line receiving pulley members rotatably mounted relative to said frame and said arms.

21. An exercise chair comprising a seat, a frame to support said seat above a surface, said frame including an upright back frame positioned to support the back of a person seated on said seat, a resistance force generator device comprising a rotatable disk and brake, a pair of flexible lines connected to rotatable pulleys to cause rotation of said disk when one or the other flexible line is extended, said brake being actuated upon rotation of said disk to provide frictional resistance to extension of said flexible line means, an operable exercise frame carried by the chair including a pair of retractable arms movably mounted to a portion of said frame of the chair and each arm being movable to a position wherein said respective arm extends outwardly from the chair, means to adjustably fix said arms at a plurality of different laterally extending positions, including a position wherein said arms are laterally within the space defined by said back of the chair, means mounted on each arm for guiding a respective one of said flexible lines to an outer end of said respective arm so that said lines are spaced from each other and positioned to be moved by a person seated on said seat, and whereby when either of said lines is moved said resistance force generating device is moved to cause a brake load on said respective line.

22. An exercise chair comprising a seat, a frame to support said seat above a surface, said frame including an upright back frame positioned to support the back of a person seated on said seat, a resistance force generator device comprising a rotatable disk and brake, a pair of flexible lines connected to rotatable pulleys to cause rotation of said disk when one or the other flexible lines is extended, said brake being actuated upon rotation of said disk to provide frictional resistance to extension of said flexible lines, an operable exercise frame carried by the chair including a pair of retractable arms pivotally mounted at inner ends thereof to the rear of said back frame of the chair about generally horizontal pivot axes, and each arm being movable to a position wherein said respective arm extends outwardly from the chair, means, including line receiving pulleys rotatably mounted relative to said frame and said arms, for guiding said flexible lines to outer ends of said respective arms so that said lines are spaced from each other and positioned to be moved by a person seated on said seat, and whereby when either of said lines is moved said resistance force generating device is moved to cause a brake load on said respective line, wherein said arms are tubular members and said flexible lines run through the interiors of said arms, said pulley members including castering pulleys at outer ends of each arm that caster about axes generally parallel to longitudinal as of said respective arms, and having pulley wheels rotating on axes perpendicular to the castering axes, and said castering pulleys being of size to guide said respective flexible line means from said outer ends of said respective arms to positions clearing outer surfaces of each such arm when said flexible lines are doubled back on the exteriors of said respective arms.

* * * * *

UNITED STATES PATENT AND TRADEMARK OFFICE

CERTIFICATE OF CORRECTION

PATENT NO. : 5,090,694

DATED : February 25, 1992

INVENTOR(S) : Edward A. Pauls et al

It is certified that error appears in the above-identified patent and that said Letters Patent is hereby corrected as shown below:

In Column 2, line 63, "located" should read --locked--.

In Column 2, lines 67 and 68, "cross section" should read --cross-section--.

In Column 3, line 19, "user" should read --used--.

In Column 3, line 30, "at" should read --in--.

In Column 3, line 30, "at" should read --as--.

In Column 3, line 55, "2" should read --23--.

In Column 5, line 42, "Fig." should read --Figs.--.

In Column 5, line 55, "springloaded" should read --spring-loaded--.

In Column 6, line 18, after the word "pulley" delete ",".

In Column 6, line 27, after the word "pulley" delete ",".

UNITED STATES PATENT AND TRADEMARK OFFICE

CERTIFICATE OF CORRECTION

PATENT NO. : 5,090,694

DATED : February 25, 1992

INVENTOR(S) : Edward A. Pauls et al

It is certified that error appears in the above-identified patent and that said Letters Patent is hereby corrected as shown below:

In Column 6, line 28, after the word "wheel" insert --member--.

In Column 6, line 36, "& the" should read --the--.

In Column 7, line 7, after the word "be" delete "a".

In Column 7, line 51, "e>:tension" should read --extension--.

In Column 8, line 42, "on to" should read --onto--.

In Column 8, line 54, "car" should read --can--.

In Column 8, line 63, after the word "Fig." insert --1--.

In Column 9, line 16, "for" should read --form--.

In Column 9, line 20, "12" should read --122--.

In Column 9, line 38, "cross section" should read --cross-section--.

In Column 9, line 38, "32" should read --132--.

UNITED STATES PATENT AND TRADEMARK OFFICE

CERTIFICATE OF CORRECTION

PATENT NO. : 5,090,694

DATED : February 25, 1992

INVENTOR(S) : Edward A. Pauls et al

It is certified that error appears in the above-identified patent and that said Letters Patent is hereby corrected as shown below:

In Column 9, line 40, after the word "members" delete "133,".

In Column 9, line 50, after the word "assemblies" delete "137,".

In Column 9, line 54, "&:he" should read --the--.

In Column 9, line 66, "44" should read --144--.

In Column 10, line 14, "157" should read --151--.

In Column 10, line 43, after the word "Fig." insert --11--.

In Column 10, line 58, after the word "the" delete "o".

In Column 10, line 66, "horsing" should read --housing--.

In Column 11, line 8, "a:.e" should read --are--.

In Column 11, line 9, "167(" should read --167B--.

UNITED STATES PATENT AND TRADEMARK OFFICE

CERTIFICATE OF CORRECTION

PATENT NO. : 5,090,694

DATED : February 25, 1992

INVENTOR(S) : Edward A. Pauls et al

It is certified that error appears in the above-identified patent and that said Letters Patent is hereby corrected as shown below:

In Column 11, line 15, after the word "pads" delete "170,".

In Column 11, line 18, after the word "springs" delete "171,".

In Column 11, line 26, "!54" should read --154--.

In Column 11, line 46, "e" should read --a--.

In Column 12, line 18, "river" should read --over--.

In Column 12, line 18, "t" should read --to--.

In Column 12, line 26, "!38" should read --138--.

In Column 12, line 32, "are" should read --arm--.

In Column 12, line 43, "lave" should read --have--.

In Column 12, line 53, after the word "members" delete "135,".

In Column 12, line 67, "Weights" should read --weights--.

In Column 13, line 16, after the word "where" delete "are".

In Column 13, line 43, "sheet" should read --seat--.

UNITED STATES PATENT AND TRADEMARK OFFICE

CERTIFICATE OF CORRECTION

PATENT NO. : 5,090,694

DATED : February 25, 1992

INVENTOR(S) : Edward A. Pauls et al

It is certified that error appears in the above-identified patent and that said Letters Patent is hereby corrected as shown below:

In Column 14, line 48, "coated" should read --seated--.

In Column 14, line 22, "as" should read --arm--.

In Column 14, line 25, "generally-downwardly" should read --generally downwardly--.

In Column 14, line 27, "chain" should read --chair--.

In Column 15, line 24, "tot he" should read --to the--.

In Column 15, line 25, "tot he" should read --to the--.

In Column 16, line 4, "9" should read --10--.

In Column 16, line 20, "operable" should read --operably--.

In Column 16, line 38, "loadign" should read --loading--.

UNITED STATES PATENT AND TRADEMARK OFFICE

CERTIFICATE OF CORRECTION

PATENT NO. : 5,090,694
DATED : February 25, 1992
INVENTOR(S) : Edward A. Pauls, et. al.

It is certified that error appears in the above-indentified patent and that said Letters Patent is hereby corrected as shown below:

In Column 18, line 40, "as" should read --axes--.

Signed and Sealed this

Nineteenth Day of October, 1993

*Attest:*

Bruce Lehman

BRUCE LEHMAN

*Attesting Officer*

*Commissioner of Patents and Trademarks*